US011846429B2

(12) United States Patent
Graham, Jr.

(10) Patent No.: US 11,846,429 B2
(45) Date of Patent: Dec. 19, 2023

(54) COOKING APPLIANCE WITH EXPANDABLE COOKTOP SURFACE

(71) Applicant: Anserd L. Graham, Jr., Cedar Park, TX (US)

(72) Inventor: Anserd L. Graham, Jr., Cedar Park, TX (US)

( * ) Notice: Subject to any disclaimer, the term of this patent is extended or adjusted under 35 U.S.C. 154(b) by 5 days.

(21) Appl. No.: 17/564,148

(22) Filed: Dec. 28, 2021

(65) Prior Publication Data

US 2022/0205642 A1 Jun. 30, 2022

Related U.S. Application Data

(60) Provisional application No. 63/131,311, filed on Dec. 28, 2020.

(51) Int. Cl.

| | |
|---|---|
| ***F24C 15/10*** | (2006.01) |
| ***F24C 3/08*** | (2006.01) |
| ***F24C 7/06*** | (2006.01) |
| ***F24C 15/08*** | (2006.01) |

(52) U.S. Cl.

CPC ..... *F24C 15/108* (2013.01); *F24C 3/085* (2013.01); *F24C 7/067* (2013.01); *F24C 15/08* (2013.01)

(58) Field of Classification Search

CPC ..... F24C 15/108; F24C 3/085; F24C 3/08; F24C 7/067

USPC ..... 126/1 R, 39 B

See application file for complete search history.

(56) References Cited

U.S. PATENT DOCUMENTS 2,882,382 A * 4/1959 Woxman ..... F24C 15/30 126/214 A 3,525,852 A * 8/1970 Filipak ..... F24C 15/102 219/478

* cited by examiner

*Primary Examiner* — Vivek K Shirsat

(74) *Attorney, Agent, or Firm* — Isidore PLLC

(57) ABSTRACT

A cooking appliance has a multi-section cooking surface that is expandable to provide a larger depth cooking surface by slideably extending a moveable front burner section of the cooking surface. The cooking appliance includes a base section extending below the cooking surface, the base section providing structure and physical support for the cooking surface. The cooking appliance includes a multi-sectioned cooking surface having a stationary rear burner section and a movable front burner section. The stationary rear burner section includes at least one rear/back burner, and the moveable front burner section includes at least one front burner. The moveable front burner section translates/slides forward away from the stationary rear burner section to provide additional/larger separation spacing between the at least one rear burner and the at least one front burner. A block insert panel is inserted into the space created between the rear burner section and the extended front burner section.

18 Claims, 15 Drawing Sheets

COOKING APPLIANCE WITH EXPANDABLE COOKTOP SURFACE

RELATED APPLICATION

This application claims priority to U.S. Provisional Application No. 63/131,311, filed Dec. 28, 2020, the content of which is fully incorporated herein by reference.

BACKGROUND OF THE INVENTION

1. Field of the Invention

The present disclosure generally relates to cooking appliances and in particular to cooking surfaces for cooking appliances with front and rear burners.

2. Description of the Related Art

Cooking appliances, such as stoves, having cooking surfaces with multiple burners are widely use in homes, restaurants, and other places for cooking and/or preparing food, etc. that require heating. The traditional cooking appliances are a single combined standing structure that incorporates the cooking surface along with a lower oven and possibly an upper oven, with the bottom of the structure placed on the ground for support. Additionally, some cooking appliances are provided as standalone, countertop appliances for countertop placement/insertion. The cooking surfaces are often manufactured with two or more burners, with the most common configuration in residential use providing four (4) burners. The four burners are arranged with two front burners and two back burners on a square or rectangular base plate. While cooking surfaces with burners can come in different shapes and widths, in part based on the number of side-by-side burners in the front or rear row of burners (e.g., 2×2 burners versus 2×3 burners), the standard stovetop or countertop cooking surface is manufactured with a fixed dimensions of width and depth to accommodate industry-accepted, traditional counter depth dimension (e.g., 26" deep) found in most homes. With the four-burner cooking surface, this industry standard depth and width for the cooktop results in the burners being relatively close to each other (both front-to-back and side-to-side), accommodating concurrent use of four small to medium sized pots and pans. For individuals who which to cook a lot of food at one time, or who has larger sized pots or cooking, the industry standard cooktop is only able to potentially accommodate two large pots placed diagonally to each other on respective diagonally-aligned burners, with two smaller burners accommodating smaller pots in the inverse diagonal. Some individuals use larger size cooking pots. If the individual wishes to cook multiple large pots of food, the cooking process has to be spread over two or more time frames, as only one or two larger pots can be accommodated on the stovetop surface at one time. Also, trying to maneuver the larger pots on the cooking surface can prove to be cumbersome, as the pots are very close to each other, and extend over the perimeter area of the burner into the next burner area, with little to no spacing between them.

SUMMARY

A cooking appliance, such as a stove or cooktop, is configured with a multi-section cooking surface that is expandable into a larger depth cooking surface by slideably extending a front burner section of the cooking surface. The cooking appliance includes a base section extending below the cooking surface, the base section providing structure and physical support for the cooking surface and including a lower structure for placement on a surface, such as a floor or countertop. The cooking appliance also includes a multi-sectioned cooking surface (or range top) integrated atop the base and having a stationary rear burner section and a front movable burner section. Each of the rear and front burner sections include a top surface in which are disposed respective front and rear burners. The stationary rear burner section includes at least one rear burner, and the moveable front burner section includes at least one front burner. The moveable front burner section translates/slides forward away from the stationary rear burner section to provide additional, larger separation spacing between the at least one rear burner and the at least one front burner.

Each of the rear and front burner sections also include a perimeter surface with opposed side walls and at least a front wall. The moveable front burner section includes a bottom surface extended from the side walls and front walls to provide a single translatable unit. The cooking appliance includes at least one sliding bracket with a (first) stationary rear section affixed to an upper surface of the base section of the appliance and a (second) front slideable section affixed below the bottom surface of the moveable front burner section. The sliding bracket enables the moveable front burner section to be slid forward and backward away from and towards the stationary rear burner section. In one embodiment, at least one additional support member is securely attached to the upper surface of the base of the cooking appliance and which extends forward, below a bottom of the moveable front burner, the support member operating in tandem with the at least one sliding bracket to provide structural support for a weight of the moveable front burner section in an extended state.

According to one aspect, the cooking appliance incudes a least one block insert panel that is sized to fit into a gap created between the stationary rear burner section and the moveable front burner section when the moveable front burner section is moved into the extended state. The at least one block insert panel fills the gap and provides additional cooking surface area behind the at least one front burner and in front of the at least one rear burner. In one or more embodiments, two different widths of block insert panels are provided and the cooking appliance is able to be expanded to two or more different depth dimensions, with the correct one or more of the block insert panels inserted to fill the width of the gap created between the rear and the front burner sections.

In one or more embodiments, the cooking appliance includes a latching mechanism having a first latching part attached to a side wall of the moveable front burner section and a second latching part attached to one of a side wall of the stationary rear burner section and a side wall of the base section of the cooking appliance. The first and second latching burner parts interconnect to secure the moveable front burner section, while in a retracted state, abutting a front of the stationary rear burner section.

In one or more embodiments, each of the at least one rear burner and the at least one front burner includes a plurality of respective burners. Also, in some embodiments, the cooking appliance is a stove and further includes an oven disposed in a volumetric space below the range top. The oven includes a door and handle for accessing an interior of the oven.

In one or more embodiments, the moveable front burner section comprises a bottom wall that is made of an insulated material to prevent transfer of heat from a base of the at least one front burner. Also, in one or more embodiments, the cooking appliance includes at least one side or front panel that attaches to and extends downwards from a bottom of the moveable front burner section as a skirt and that prevents access to a space directly beneath the moveable front burner section when the moveable front burner section is in the extended state.

The cooking appliance further includes control knobs for turning on and controlling a heat intensity of respective ones of the at least one rear burner and the at least one front burner. The cooking appliance further includes one of both of: a flexible gas line that sealable connects at a gas intake connector of at least one front gas burner and which extends from a retracted state when the moveable front burner section is extended forward, the flexible gas line having a second connector that is connectable to a gas intake line outside of the stove; and a flexible electrical cable that electrically connects to a heating element of at least one front electrical burner and which extends from a retracted state when the moveable front burner section is extended forward, the flexible electrical cable connecting to a control circuit that receives electrical power via an electrical power line that is connectable to an external electrical power source.

According to one aspect, an alternate configuration is provided with an expandable width cooking surface. The burner sections are divided front to back to create side-by side burner sections, with a right side and/or a left side that are translatable outward to the right and left, respectively, to provide an expandable width cooking surface. The block insert panel is then inserted from back to front into the gap created following the expansion.

According to a different aspect, a method for manufacturing a cooking appliance with an extendable/expandable cooking surface is provided. The method includes incorporating a first stationary rear burner section of a multi-sectioned cooking surface into a top of the appliance. The method includes attaching a first fixed section of at least one sliding bracket to a front upper surface of the top of the appliance. The method then includes providing a second moveable front burner section of the cooking surface and attaching a second moveable section of at least one sliding bracket to a base of the moveable front burner section. The at least one sliding bracket enables the moveable front burner section to be translated forward into an extended state and then backwards to a retracted state. The method further includes providing at least one block insert panel that can be inserted into a space/gap created between the stationary rear burner section and the moveable front burner section when the moveable front burner section is translated forward to an extended state. Providing the insertable block panel includes manufacturing the block insert panel with a high heat resistant surface.

The above summary contains simplifications, generalizations and omissions of detail and is not intended as a comprehensive description of the claimed subject matter but, rather, is intended to provide a brief overview of some of the functionality associated therewith. Other systems, methods, functionality, features and advantages of the claimed subject matter will be or will become apparent to one with skill in the art upon examination of the following figures and detailed written description.

BRIEF DESCRIPTION OF THE DRAWINGS

The description of the illustrative embodiments can be read in conjunction with the accompanying figures. It will be appreciated that for simplicity and clarity of illustration, elements illustrated in the figures have not necessarily been drawn to scale. For example, the dimensions of some of the elements are exaggerated relative to other elements. Embodiments incorporating teachings of the present disclosure are shown and described with respect to the figures presented herein, in which.

DESCRIPTION OF ILLUSTRATIVE EMBODIMENTS

The present disclosure provides a cooking appliance, such as a stove or cooktop, configured with a multi-section cooking surface that is expandable into a larger depth cooking surface by slideably extending a front burner section of the cooking surface. The expandable, multi-sectioned cooking surface enables forward translation of the front burner section that increases both (i) the depth dimension of the cooking surface and (ii) spacing between each front and back burner and each diagonal burner. The expandable, multi-sectioned cooking surface for greater flexibility with use of the burners to accommodate cooking using multiple large pots by providing larger separation space between the burners and the cooking utensils.

Figure 1B:
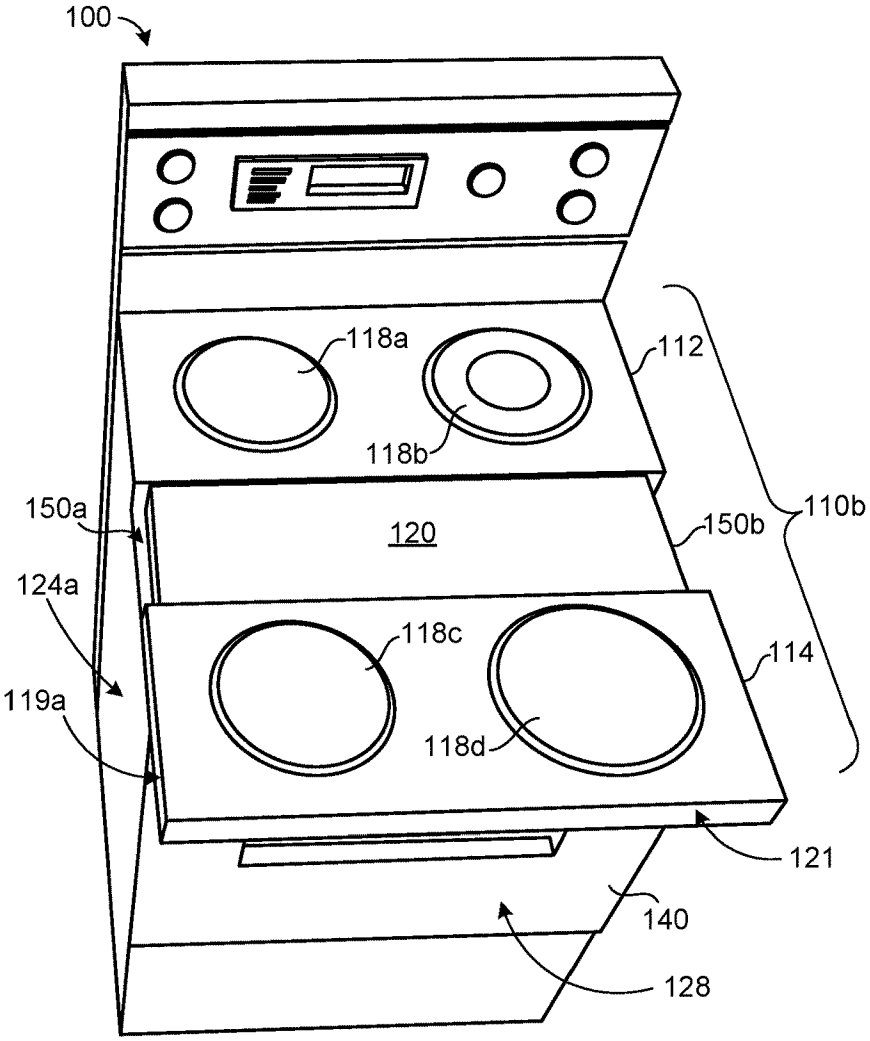
FIGS. 1B and 1C illustrate two different three-dimensional views of the expandable-depth cooking appliance configured with a stationary rear burner section having two back burners, a block insert panel, and a moveable front burner section having two front burners, according to one or more embodiments.
Figure 1A:
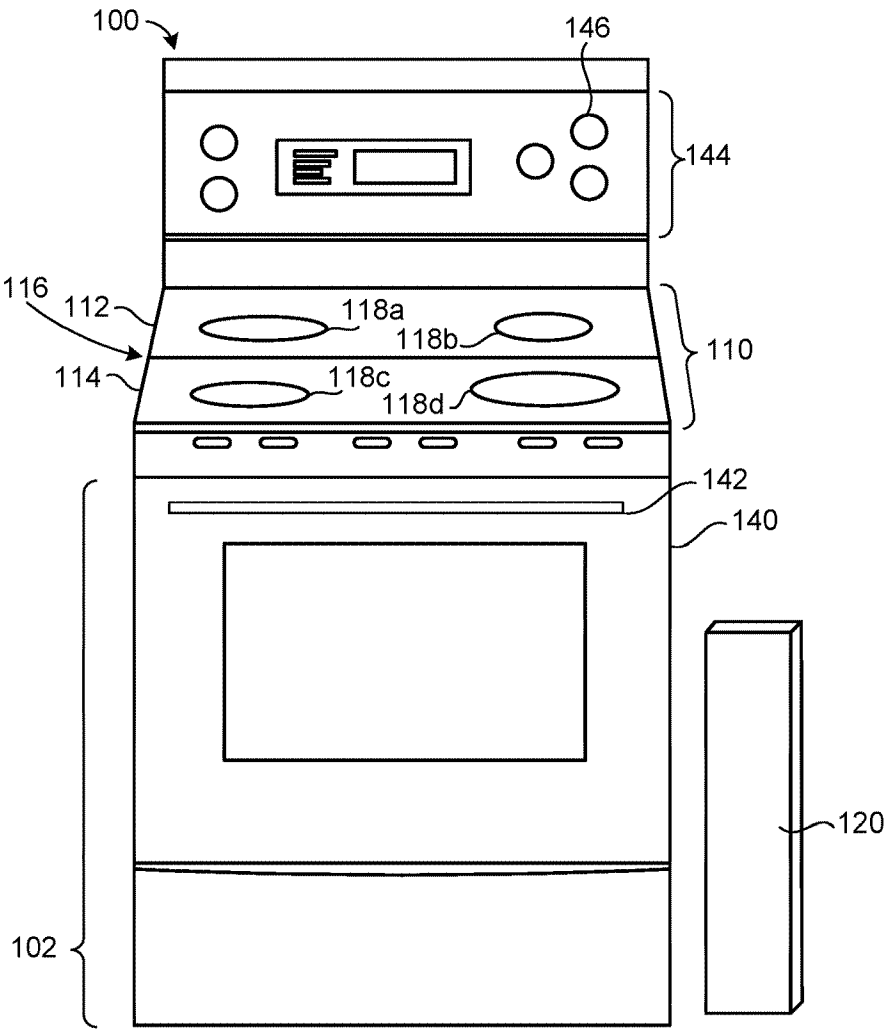
FIG. 1A presents a three-dimensional illustration of a cooking appliance, which is a four-burner stove having standard base dimensions and configured with a stationary rear burner section and an expandable cooking surface having a moveable front burner section to enable expansion of the cooktop surface, in accordance with one of more embodiments.
Figure 1C:
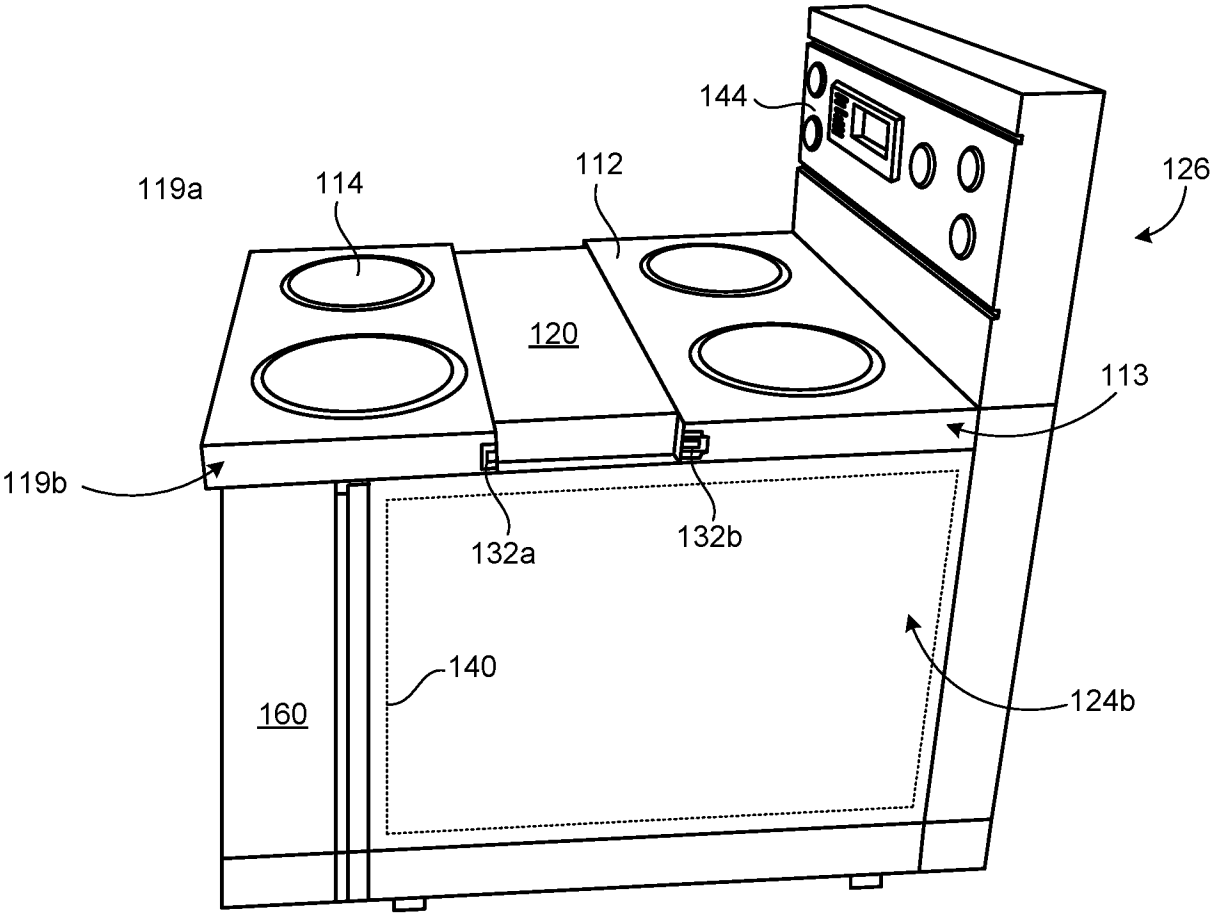

With reference now to the figures, and beginning with FIGS. 1A-1C, there are illustrated embodiments of cooking appliance 100 with an expandable cooking surface. Specifically, FIG. 1A presents a three-dimensional illustration of a four-burner stove, which is a specific example of cooking appliance 100 used in most of the presented embodiments; and is thus hereinafter referred to as cooking appliance 100. It is appreciated that cooking surface 110 of cooking appliance 100 can include less or more burners (118*a*-118*d*), without specific limitation other than the presence of two adjacent burners that can be physically spaced apart from each other as a normal part of the mechanism for expanding the depth (or width) of the cooking surface. Additionally, as described later with respect to FIGS. 10 and 11A-11C, cooking appliance (100*f*, 100*g*) can also be a tabletop or countertop cooking appliance, rather than a complete stove with a base section that extends down to the floor. References to cooking appliance 100 are assumed to include each different form of cooking appliance, regardless of the specific illustration presented.

Returning to FIG. 1A, cooking appliance 100 includes base section 102 extending below the cooking surface 110. Base section 102 provides structural and physical support for cooking surface 110 and includes a lower structure (not shown) for placement on a surface, such as a floor or countertop. Base section 102 has standard base dimensions of width and depth, with sides 124*a*, 124*b*. Cooking appliance 100 also includes multi-sectioned (e.g., two-sectioned), expandable cooking surface (or range top) 110 having stationary rear burner section 112 and movable front burner section 114, abutting each other at dividing joint 116. Moveable front burner section 114 enables expansion of the cooking surface 110. Each of the rear and front burner sections 112, 114 include a top surface in which is disposed respective back burners 118*a*, 118*b* and front burners 118*c*, 118*d*. Stationary rear burner section 112 includes at least one back burner 118*a*-118*b*, and moveable front burner section 114 includes at least one front burner 118*c*-118*d*.

To the right of cooking appliance is block insert panel 120. An expansion insert is provided with the stove to support a later expansion of the cooktop surface. In one embodiment, the expansion insert is manufactured with a dimension that allows for easy storage inside the oven and the insert is stored inside the base oven when the insert and the oven are not in use. It is appreciated that the features and functionality presented herein are applicable to both gas-burning stovetops as well as electrical stovetops.

Referring now to FIGS. 1B and 1C and with ongoing reference to FIG. 1A. FIGS. 1B and 1C illustrate two different three-dimensional views of cooking appliance 100 as a four-burner stove configured with moveable front burner section 114 having two front burners 118*c*, 118*d*, translated forward away from stationary rear burner section 112 having two back burners 118*a*, 118*b*, and with block insert panel insert 120 substantially filling the space/gap 150 created between the rear and front burner sections, according to one or more embodiments. According to the illustrative embodiments, cooking appliance 100 incudes at least one block insert panel 120 that is sized to fit into space/gap 150 (FIG. 1B) that is created between the stationary rear burner section 112 and moveable front burner section 114 when the moveable front burner section is moved into the extended state. The at least one block insert panel 120 fills the gap to create a continuous cooking surface at the height of the area surrounding the burners 118*a*-118*d*, and thus provides additional cooking surface area and extended spacing behind the at least one front burner and in front of the at least one rear/back burner and between diagonal burners 118*a* and 118*d* or 118*b* and 118*c*. In one or more embodiments, as illustrated by FIGS. 8B-8D and FIGS. 9A-9C, two different widths of block insert panels 120*a*, 120*b* are provided, and cooking appliance 100 is thus able to be expanded to two or more different depth dimensions, with the correct one or more of block insert panel 120 selected and inserted to fill substantially the entire width of space/gap 150 created between the rear and the front burner sections 112, 114. The moveable front burner section 114 translates/slides forward away from the stationary rear burner section 112 to provide additional/larger separation spacing (150) between the at least one rear burner 118*a*-118*b* and the at least one front burner 118*c*-118*d*.

In one or more embodiments, the cooking appliance includes a latching mechanism 132 having first latching part 132*a* attached to side wall 119 of moveable front burner section 114 and second latching part 132*b* attached to one of a side wall 113 of the stationary rear burner section 112 and side wall 122*b* of base section 102 of cooking appliance 100. The first and second latching parts 132*a*, 132*b* interconnect to secure moveable front burner section 114, while in a retracted state, abutting a front of stationary rear burner section 112.

In the illustrative embodiments, each of the at least one rear/back burner 118*a*, 118*b* and the at least one front burner 118*c*, 118*d* includes a plurality of respective rear and front burners. Also, in some embodiments, cooking appliance 100 is a stove (as generally shown) and further includes an oven 140 disposed within a volumetric space (shown by dashed lines) below the upper cooking surface 110. Oven 140 includes frontside door 105 with handle 142 for accessing an interior of oven 140. Cooking appliance 100 further includes a burner control section 144 having control knobs 146 for turning on and controlling a heat intensity of respective ones of the at least one rear/back burner 118*a*-118*b* and the at least one front burner 118*c*-118*d*, and where provided, the oven 140.

Additional, in one or more embodiments, cooking appliance 100 includes at least one side or front panel 160 that attaches to and extends downwards from a bottom of the extended moveable front burner section 114, serving as a skirt that prevents access to a space directly beneath the moveable front burner section when the moveable front burner section 114 is in the extended state. The front panel 160 can be made of a lightweight material that may also serve as a heat barrier in addition to the additional safety feature for preventing a child from walking beneath the extended burners. The attachment can be magnetic with magnetic material incorporated into a top portion of the front panel 160 to attach to the metal side panel of the front portion of the extended front burner section 114. Alternatively, or in addition, the attachment can also be a mechanical attachment, with hooks provided at the top portion of the front panel 160 to engage holes presented within the front side walls of the front burner section 114, or vice versa.

In the following descriptions, like elements are presented with similar reference numerals as the initial figures. Some of these elements are not describe, having already been introduced in the previous descriptions of FIGS. 1A-1C. Where appropriate, a letter of the alphabet (a, b, c) is provided after the leading reference numeral (e.g., cooking appliance 100*b*) to indicate some physical or functional differences between the two components identified with similar leading reference numeral. In describing the following figures, occasional reference is made to features presented and described within previous figures, without necessarily providing a reference to a specific figure number.

Figure 2B:
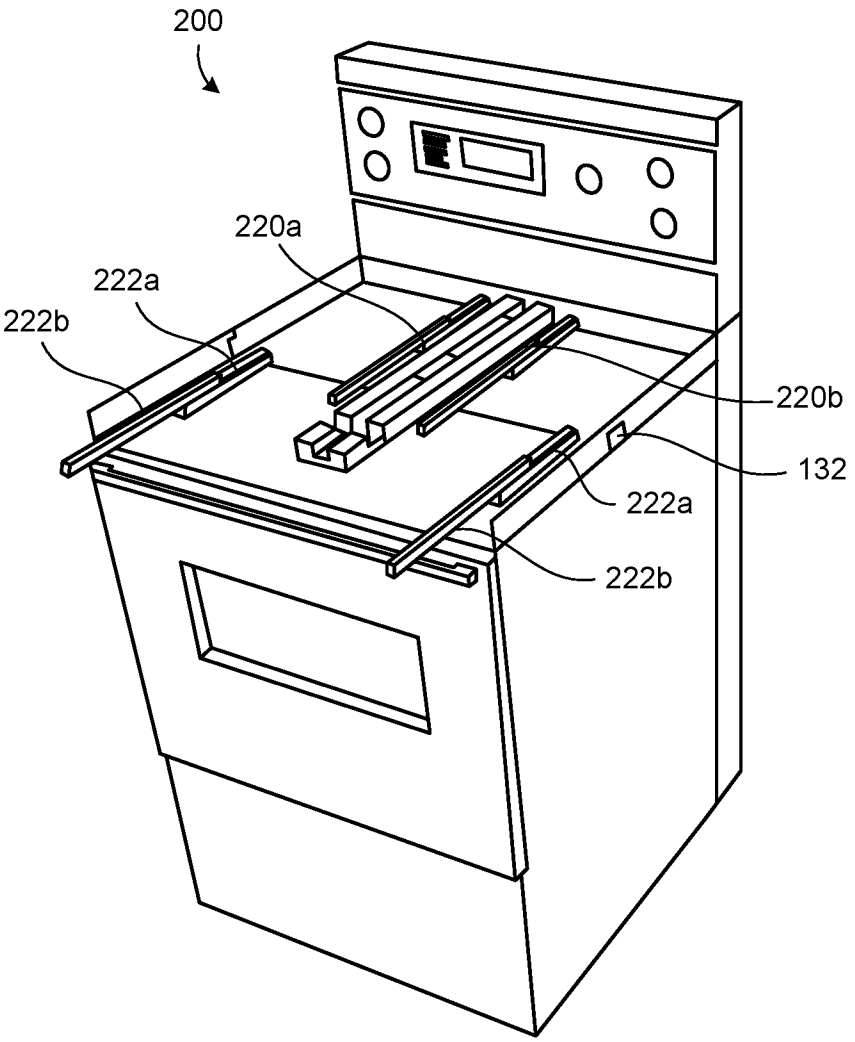
FIGS. 2A-2D illustrate different three-dimensional views of a base configuration of an expandable four-burner cooking appliance configured with support blocks and three sliding brackets that are spaced apart on a base surface to enable installation of the slideable front burner section, according to several embodiments.
Figure 2A:
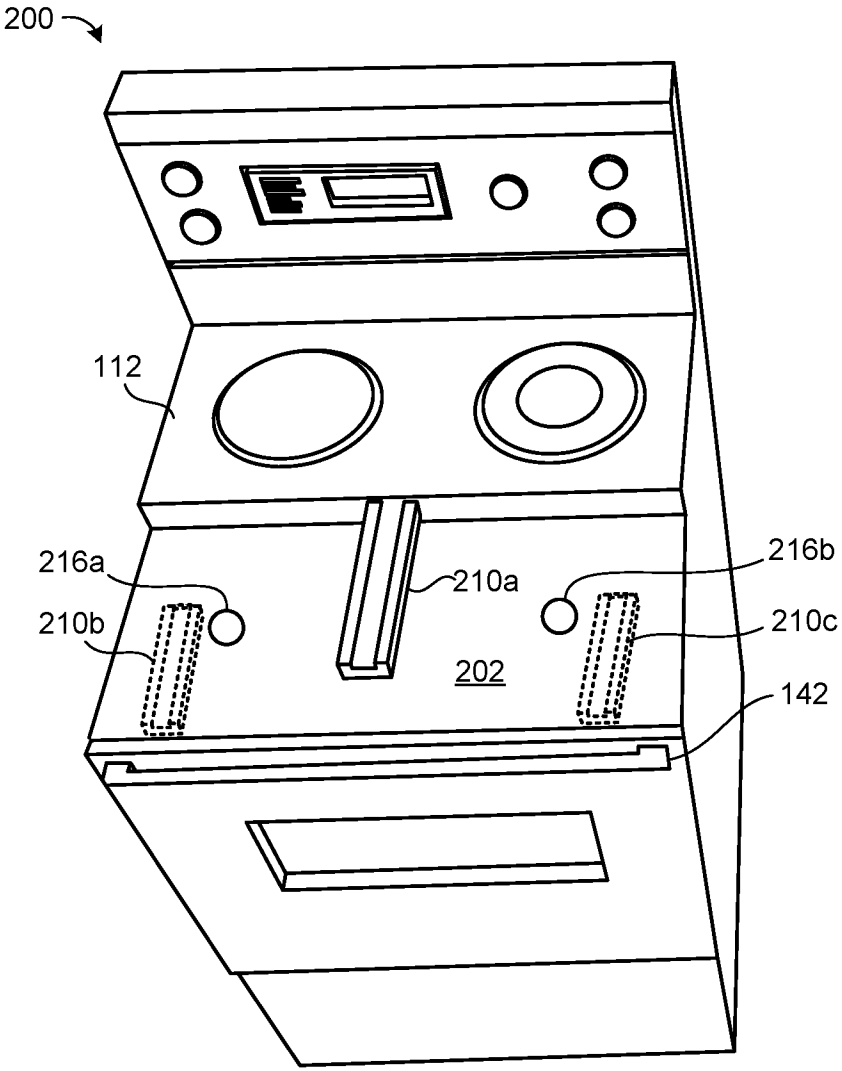
Figure 2D:
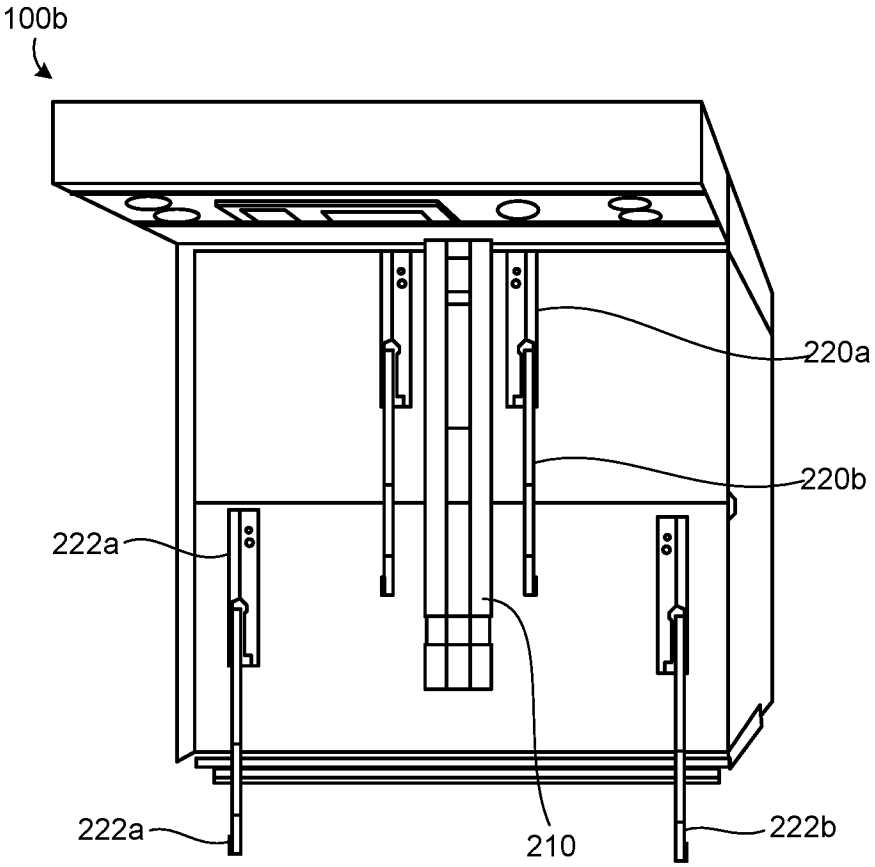
Figure 2C:
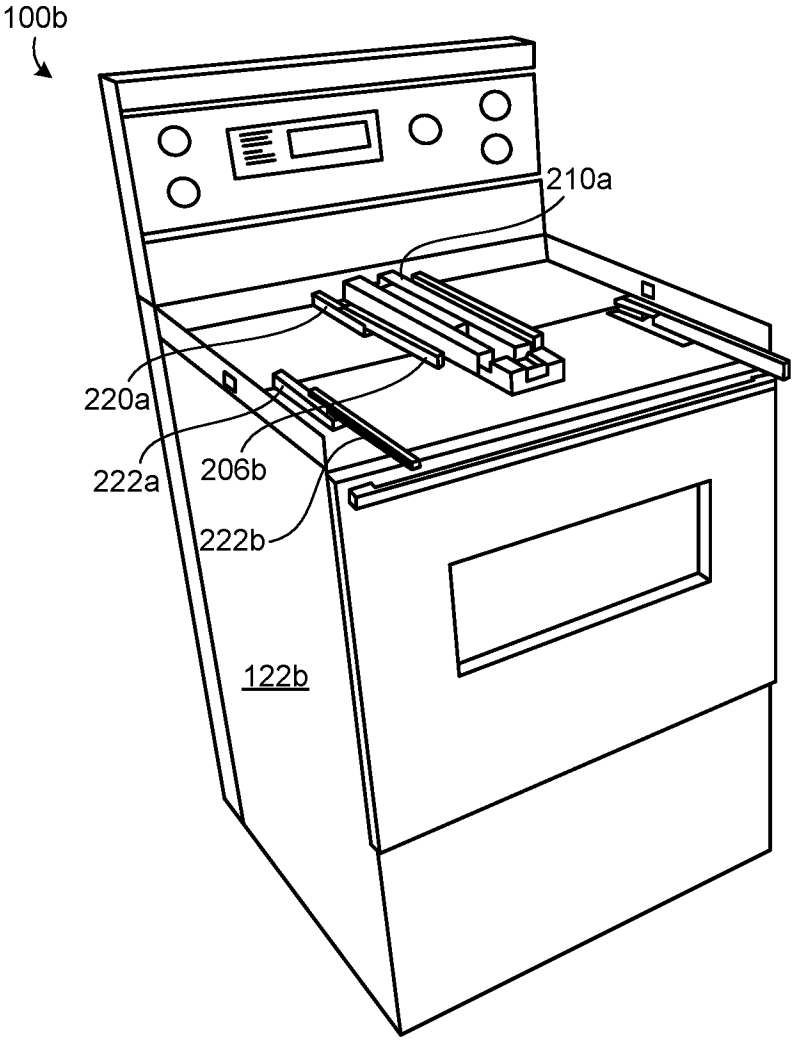

FIGS. 2A-2D illustrate different three-dimensional views of a base configuration of an expandable four-burner stove (referred to hereinafter as cooking appliance 100*b*) configured with base supports and three sliding brackets that are spaced apart on a stove base to enable installation of a slideable front burner section, according to a plurality of embodiments. Beginning with FIG. 2A, three base supports are provided, with two side base supports 210*a*, 210*b* and central base support 210*c*. Base supports 210 are physically affixed to a top surface 202 of base section 102. Referring to FIGS. 2B-2D, central base support extends from the back of base section 102 below stationary rear burner section 112 to provide greater counter balancing of the forward weight of moveable front burner section 114 when moveable front burner section 114 is extended past the front wall of base section 102. Cooking appliance 100*b* includes at least one sliding bracket 220*a*-220*d* with (first) stationary rear section 222*a* affixed to an upper surface of the base section 102 of cooking appliance 100*b* and (second) front slideable section 222*b* affixed below the bottom surface of moveable front burner section 114. The at least one sliding bracket 220*a*-220*d* enables the moveable front burner section 114 to be slid/translated forward and backward away from and towards the stationary rear burner section 112. In one embodiment, at least one additional support member 210*a*-210*c* is securely attached to the upper surface of the base section 102 of cooking appliance 100*b* and extends forward below a bottom panel of moveable front burner section 114. The at least one support member 210*a*-210*c* operate in tandem with the at least one sliding bracket 220*a*-220*d* to provide structural support for a weight of the moveable front burner section in an extended state. At least one access hole 216*a*-216*b* allows for at least one electrical cable and/or at least one gas conduit to extend up to the at least one front burner 118*c*-118*d* from a lower compartment of base section 102.

Within the illustrative embodiment, a larger sliding bracket assembly (or two adjacent sliding brackets) is provided down the center of the base surface of the stove. This larger sliding bracket assembly can be designed to accommodate slideable movement of both a rear burner assembly as well as the front burner assembly. Additionally, two mounted sliding rails are attached on the top left and right sides of the base surface for receiving the slideable front burner section.

As further presented in the figures, support member 210 is a bracket that extends lengthwise from a front of or from below the stationary rear burner section 112 towards and underneath the moveable front burner section 114 of cooking appliance 100. The support member 210 provides the supporting structure for keeping the sliding brackets secured to the base of a moveable front burner section 114.

A side latch is also shown attached to the side walls of both rear and front burner sections 112, 114. The side latches mate and/or automatically engages when the front burner section 114 is slid/translated back towards rear burner section 112 such that back panel of front burner section 114 abuts the exposed front-side of rear burner section 112. According to one embodiment, a locking device (not specifically shown) is also provided for safety in order to prevent the front burners from being pushed in by accident while being utilized. The locking device can be automatically triggered when the front burner assembly reaches the end of the sliding latch and then requires a manual release of the lock by an adult user of the cooktop after use. In one embodiment, a safety locking mechanism locks the front burner section 114 in place by pulling the section (114) forward. The front burner section 114 can then be released by the user holding both extended ends/corners on the front, lifting the front up slightly, and sliding the front burner section 114 to return to the normal retracted position.

Figure 3A:
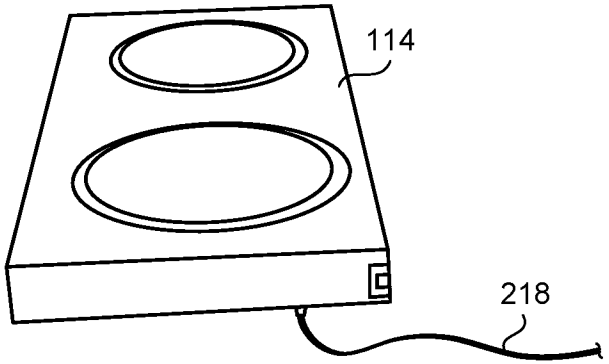
FIGS. 3A-3B illustrate two side views of moveable front burner section of the cooking appliance with electrical burners that are powered using electrical cable, according to one or more embodiments.
Figure 3B:
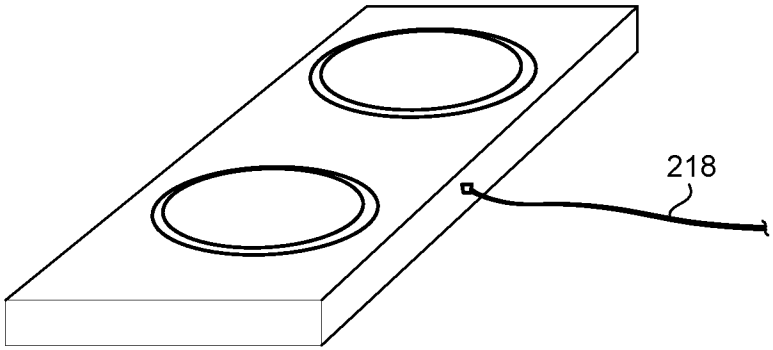

FIGS. 3A-3B illustrate different views of moveable front burner section, according to one or more embodiments. Front burner section 114 is an assembly of the front burners and the surrounding physical structure of side, front, back, bottom and top panels that enclose the different sections of front burners. As shown, front burner section 114 includes perimeter and bottom surface panels. Front burner section 114 is presented having opposed side panels 119*a*, 119*b* and at least front panel 121. A complete rear panel is also provided in the illustrated embodiments; however, in alternate embodiments, a partial panel may be provided versus a complete panel. The moveable front burner section 114 includes a bottom panel 323 extended from the opposed side panels 119*a*, 119*b* and front panel 121 to provide a single enclosed translatable unit. In one or more embodiments, at least bottom panel 323 of moveable front burner section 114 is made of an insulated material to prevent transfer of heat from below the at least one front burner 118*c*-118*d*.

Figure 4A:
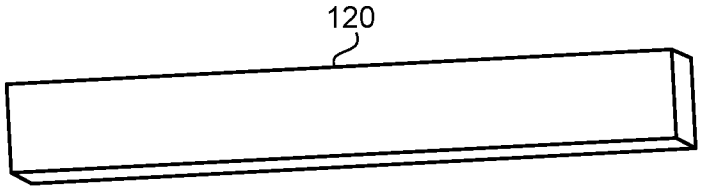
FIGS. 4A-4B illustrates a top and a side view of example block insert panel with a top surface and side base sections designed to support the weight of cooking utensils placed atop the block insert panel.
Figure 4B:
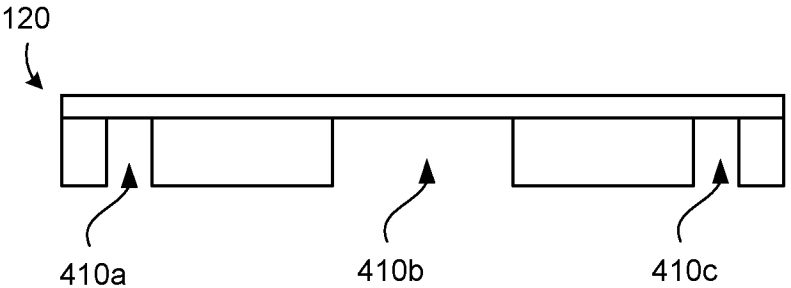

FIG. 4A-4B provide top perspective and side views of block insert panel 120 according to one or more embodiments. In a first embodiment, presented by FIG. 4A-4B, block insert panel 120 is a solid rectangular cuboid block having width, length, and height dimensions that enable block insert panel 120 to fill the entirety of the gap/space created when moveable front burner section 114 is fully (or partially) extended to yield a gap/space with similar width dimensions of block insert panel 120. To accommodate the slideable brackets 220*a*-220*c* and or support blocks 210*a*-210*c*, bottom surface of block insert panel 120 includes appropriately-sized and appropriately-spaced indentations 410*a*, 410*b*, 410*c* at the locations of the slideable brackets 220*a*-220*c* and/or support blocks 210*a*-210*c*. Block insert panel 120 can be made of a lightweight strong tensile strength material that enables the weight of a pot filled with cooking ingredients, etc., to be placed thereon without the panel flexing. The lateral side walls of block insert panel 120 provide added structural support for the weight of cooking utensils that can be placed on top of block inert panel 120. Different designs of block insert panel 120 can be used in alternate embodiments.

Block insert panel 120 is a middle expansion insert that fills in the space that is created when the front burner assembly (moveable front burner section 114) is pulled forward. This insert panel provides the functionality of adding to the surface area of the stovetop to allow for maneuvering of the cooking utensils burner as well as prevent food and other items from dropping between the front and rear burner sections 112, 114. Additionally, the insert panel provides a mechanical stop to prevent the front burners from sliding back towards the read burners while the burners are being utilize. The insert panel also provides an aesthetically appealing look to the expanded cooktop.

Figure 5B:
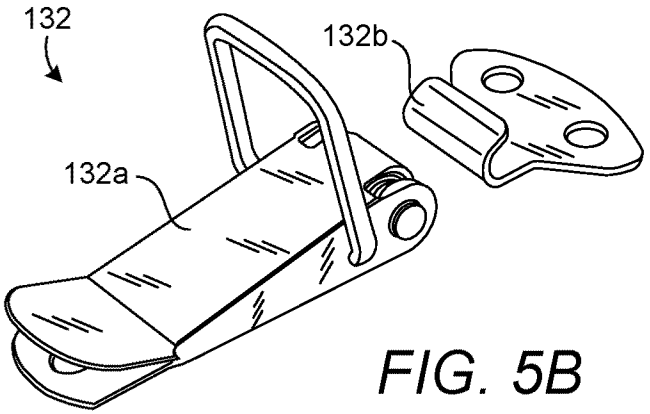
FIGS. 5A-5D presents different parts and accessories utilized within the expandable cooktop/stove, according to several embodiments.
Figure 5C:
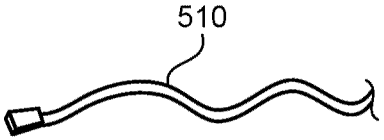
Figure 5D:
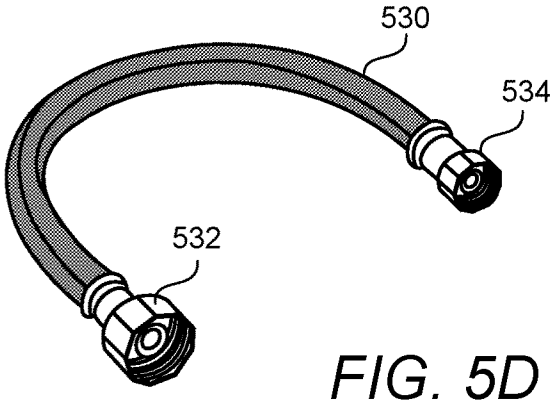
Figure 5A:
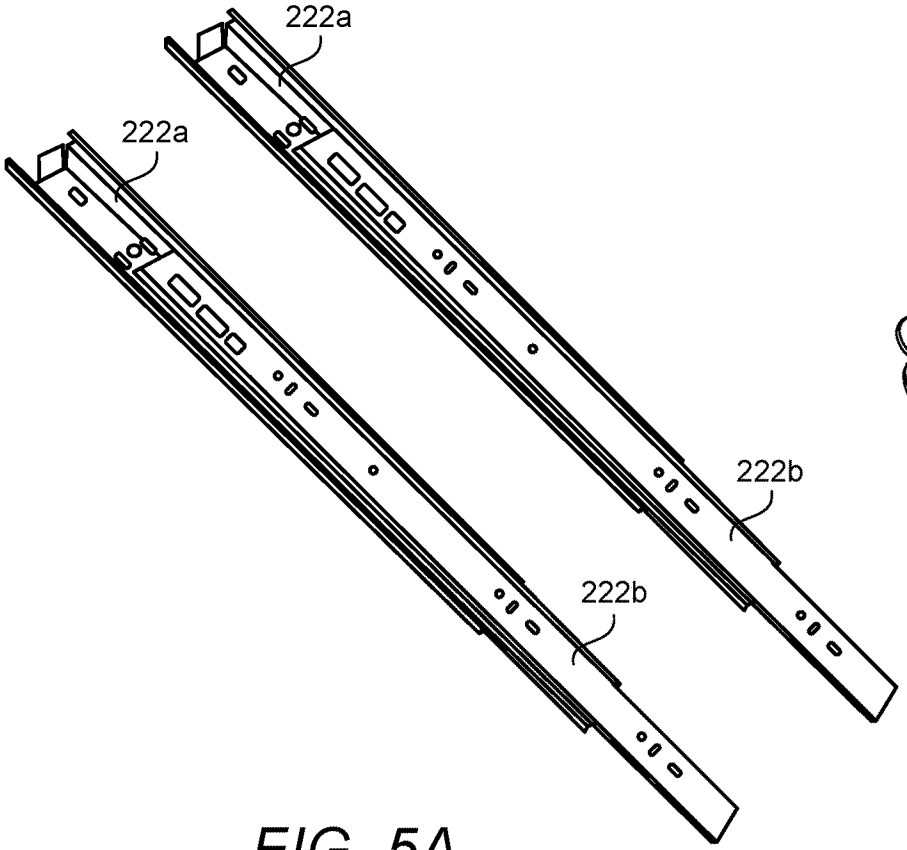

FIGS. 5A-5D presents different parts and accessories utilized within cooking appliance 100, according to a plurality of embodiments. FIG. 5A illustrates a close-up view of example slideable bracket 220 with back bottom section 222*a*, which can be attached to base section 102 of cooking appliance 100 and front upper section 222*b*, which can be attached to a base panel of moveable front burner section 114 of cooking appliance 100. It is understood that both sections 222*a* and 222*b* slide relative to each and that the configuration and use of the two sections of slideable bracket can be reversed/flipped relative to each other and the moveable front burner section 114.

FIG. 5B illustrates example latching mechanism 132 having a moveable latch portion 132*a* and a fixed latch receiving portion 132*b*. Different latching mechanisms can be used and the provided example are merely for illustration. FIG. 5C illustrates an example flexible electrical cable 510 with a connector end used to connect an electrical heating element of an electric burner to an electrical supply. FIG. 5C illustrates an example flexible gas line/conduit 520 with connectors 522, 524 at opposed ends used to connect a gas burner to an external gas supply.

Generally, cooking appliance 100 (FIG. 1) further includes one of both of:

(i) a flexible electrical cable 510 that electrically connects to a heating element (not shown) of at least one front electrical burner 118*c*-118*d*. The flexible electrical cable 510 extends from a retracted state when the moveable front burner section 114 is extended forward and coils up into available flex space when the moveable front burner section 114 is moved backwards to the retracted position. The flexible electrical cable 510 connects to an electrical panel or control circuit 610 that receives electrical power via an electrical power line 612 that is connectable to an external electrical power source (not shown). It is appreciated that the shut-offs and heat intensity control knows and features associated therewith are integrated into the design of cooking appliance 100*c* similarly to a standard electrical burner cooktop; and (ii) a flexible gas line 520 that sealable connects via first connector 532 at a gas intake connector (not shown) of at least one front gas burner 118*c*-118*d* shown with single burners 702*a*, 702*b* below raised grills 704. The flexible gas line 520 extends from a retracted state when the moveable front burner section 114 is extended forward and curls up or contours into available flex space when the moveable front burner section 114 is moved backwards to the retracted position. The flexible gas line 520 has a second connector 534 that is fluidly connectable to a gas intake line outside of the cooking appliance 100*c*. It is appreciated that the shut-offs and heat intensity control knobs (728) and features associated therewith are integrated into the design of cooking appliance 100*d* similarly to a standard gas burner cooktop.

Figure 6:
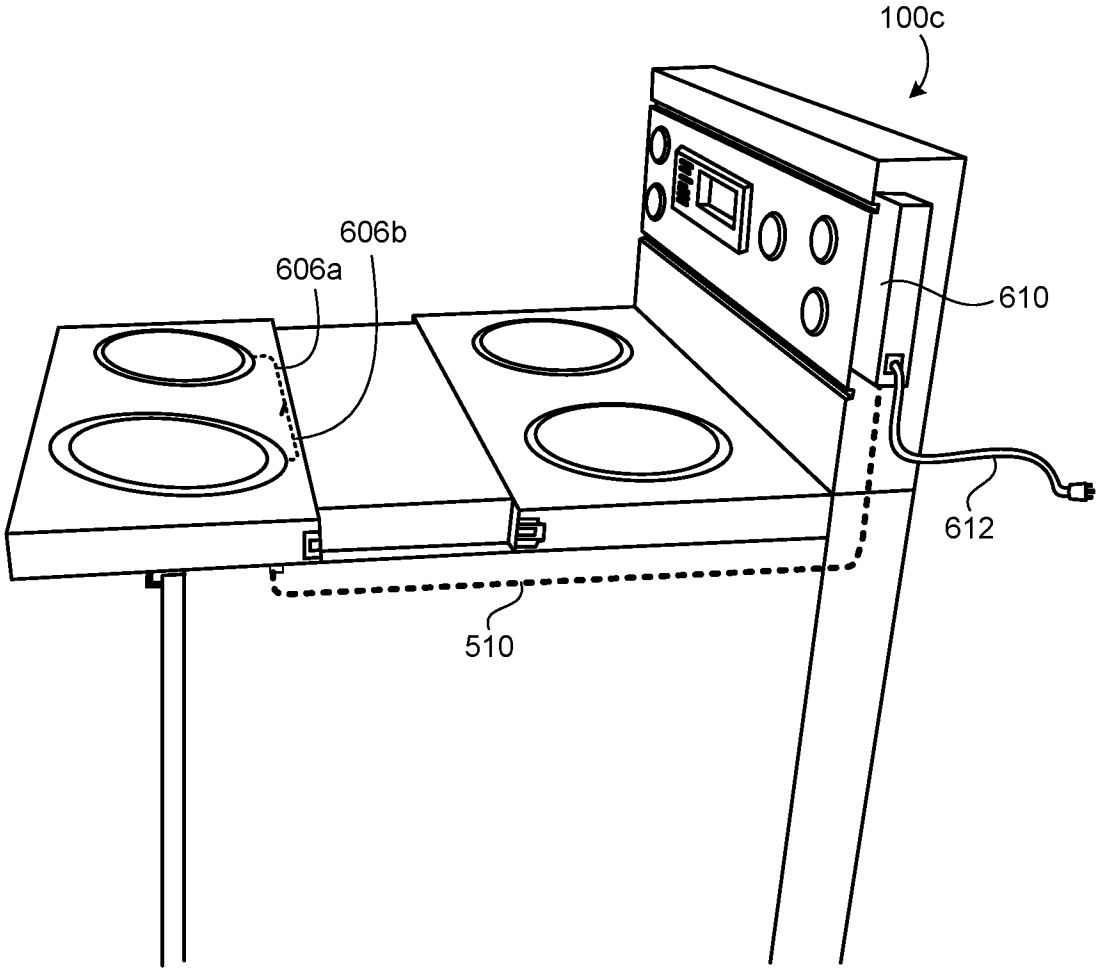
FIG. 6 illustrates an electric, expandable four burner stove with electric heating elements (burners) coupled to a flexible electrical supply cable that accommodates the forward and backward movement of the moveable front burner section, according to one or more embodiments.
Figure 7B:
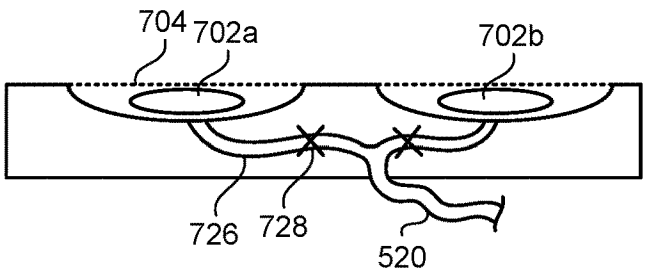
FIGS. 7A-7B illustrates a gas fueled, expandable four burner stove and moveable front burner section with gas burners fluidly coupled to a flexible gas supply line that accommodates the forward and backward movement of the moveable front burner section, according to one or more embodiments.
Figure 7A:
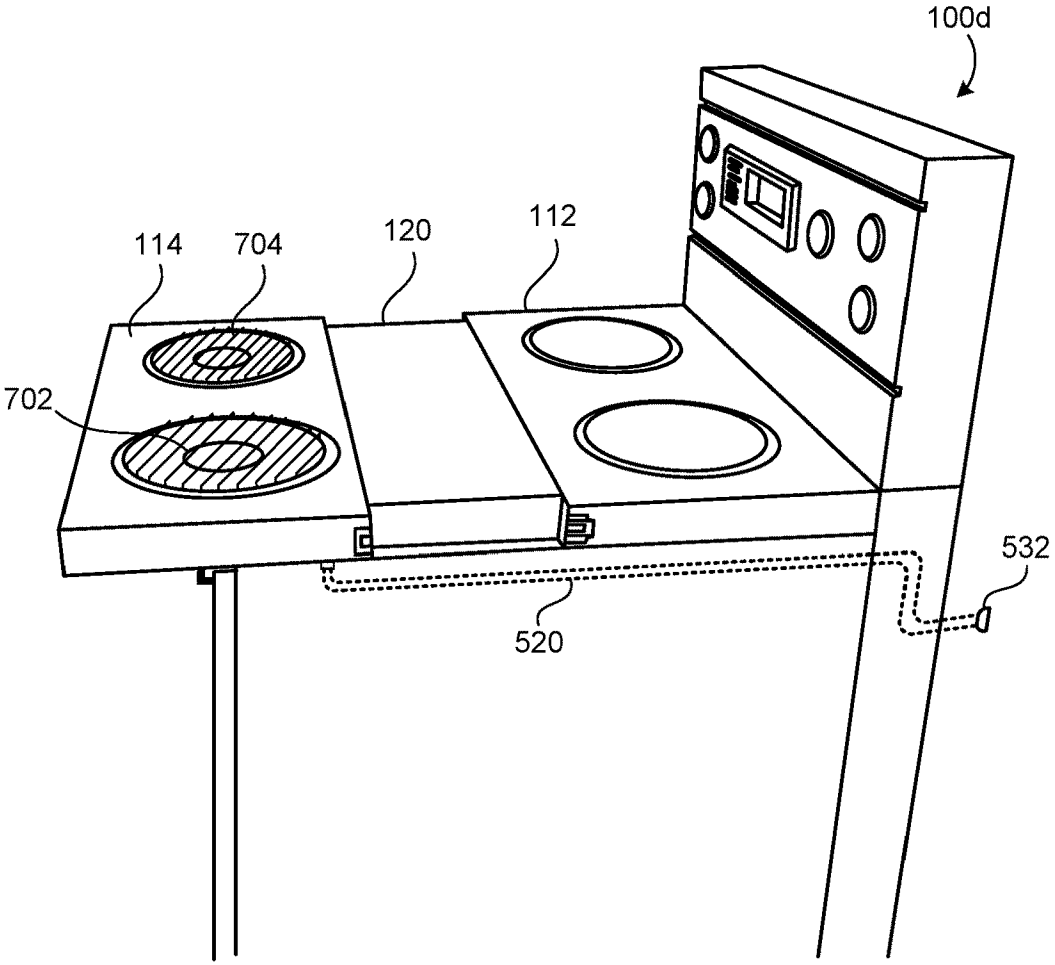

FIG. 6 illustrates an example electrical cooking appliance 100*c* in which the front burners 118*c*-118*d* are electrically powered via a one or more flexible electric cables 510. Specifically, FIG. 6 illustrates an electric, expandable four burner stove with electric heating elements (burners) coupled via cables 606*a*, 606*b* to a flexible electrical supply cable 510 that accommodates the forward and backward movement of the moveable front burner section, according to one or more embodiments. FIG. 7A-7B illustrate an example gas-fueled cooking appliance 100*d* and gas burner section, respectively, where the burners are powered by a gas source external to cooking appliance 100*d*. Specifically, FIG. 7A illustrates a gas fueled, expandable four burner stove with gas burners 704 fluidly coupled to a flexible gas supply line 730 that accommodates the forward and backward movement of the moveable front burner section, according to one or more embodiments.

Figure 8B:
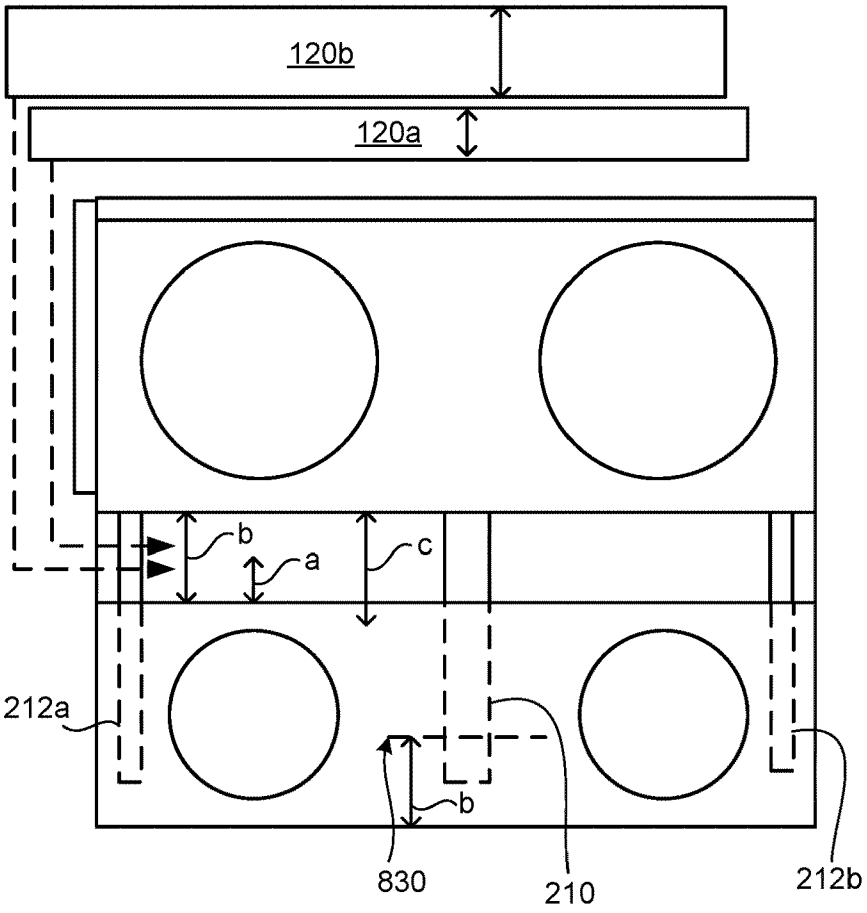
FIGS. 8A-8C presents two-dimensional planar views depicting the expansion sequence of the front burners in a four-burner cooktop having a moveable front burner section that extends beyond the front vertical plane of the countertop or base oven, with one or more block insert panels, according to one or more embodiments.
Figure 8A:
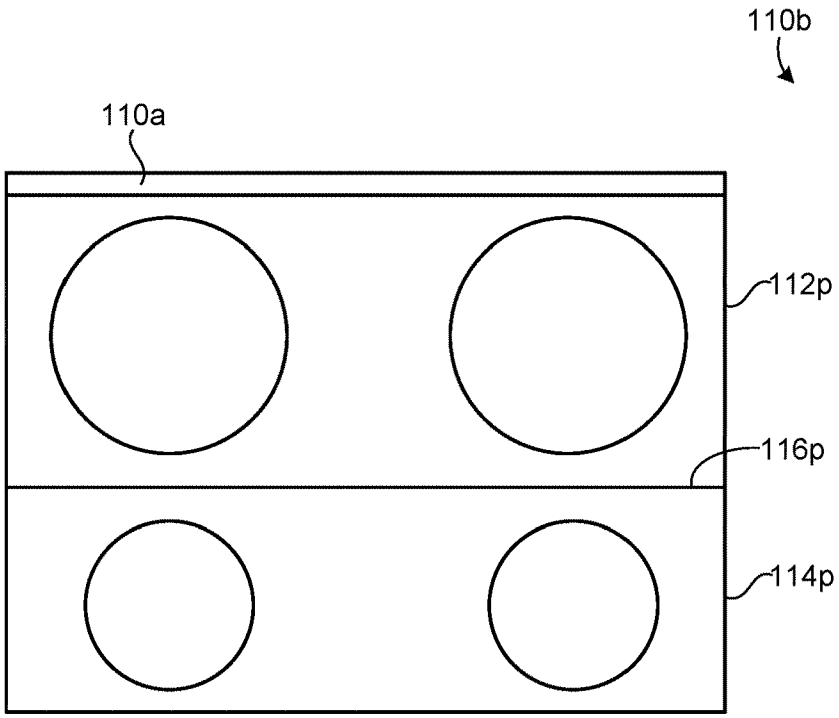
Figure 8D:
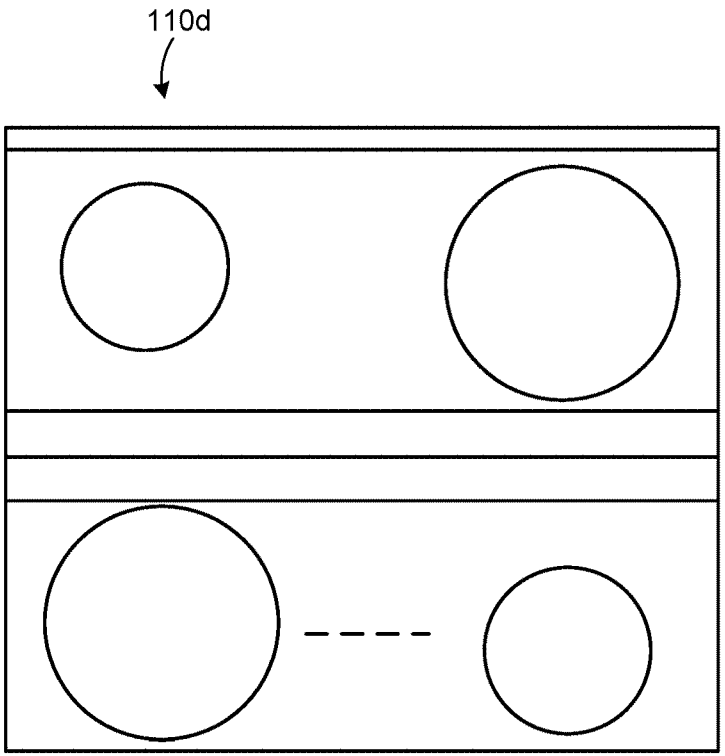
FIG. 8D illustrates the expansion of a four-burner cooktop having two diagonally-placed larger burners, according to one or more embodiments.
Figure 8C:
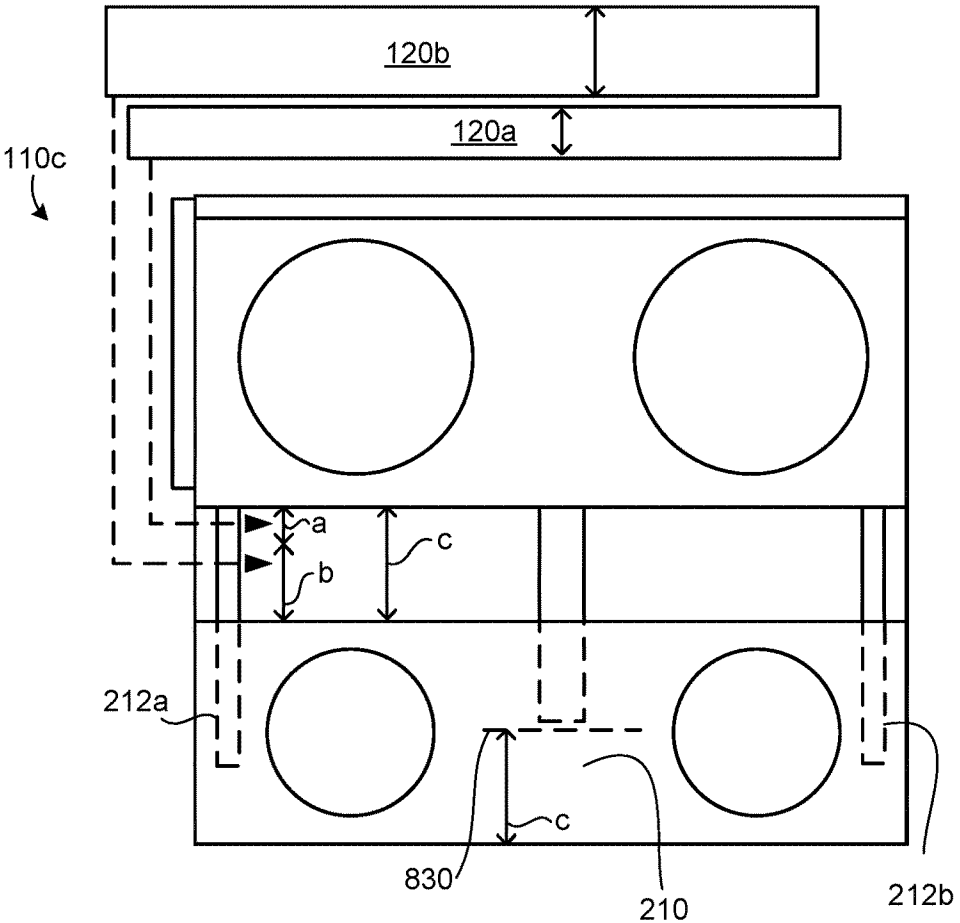

Referring now to FIGS. 8A-8D, there are illustrated a sequence of top down (or birds eye) isolated views of cooking surface 110*a*-110*d* configured with four burners with front burner section that is expandable using different dimensions of block insert panels, in accordance with multiple embodiments. FIG. 8A shows cooking surface 110*a*-110*d* without any extension, where moveable front burner section 114 abuts stationary rear burner section 112 at connecting joint 116. FIGS. 8B-8D specifically presents two-dimensional planar views depicting the expansion sequence of the front burners in a four-burner cooktop having a moveable front burner section that extends beyond the front vertical plane of the countertop or base section/oven, with one or two block insert panels, according to one or more embodiments. Beginning with FIG. 8B, there is illustrated cooking surface with moveable front burner section 114 extended outwards to one of a first partially extended distance or second fully extended distance to respectively accommodate insertion of a first width block insert panel 120*a* or second width block insert panel 120*b*. Second width block insert panel 120*b* is wider than first width block insert panel 120*a*. Example widths can be 2" versus 4" or 2" versus 6". According to one aspect, different width panels are provided for use with cooking appliance 100 to enable a user to selectively decide on the amount of extended depth desired for burner spacing on cooking surface 110*a*-110*d*. As shown by FIGS. 8B-8D, different depths can be achieved with the use of these different block insert panels, and two different sizes of block insert panels can be used simultaneously, adjacent to each other, to achieve a different width from a simple whole number multiplication of the smallest width block insert panel. The relative increase in depths can be seen with reference to the front vertical wall marker (dashed line 830) of base section 102 of cooking appliance 100.

The moveable front burner section 114 presented by FIGS. 8A-8C have smaller front burners to account for an expansion of the front burners extending beyond the front plane of the base oven, according to one or more embodiments. With this embodiment, the balance of the stovetop is not compromised as the smaller pots are placed at the front of the stove, where the front burners overhang the exterior base wall of the stove base. The front burners can also accommodate larger pots because of the increase stovetop space behind the burners.

FIG. 8D more specifically illustrates the expansion of a four-burner cooktop 110*d* having two diagonally-placed larger burners, according to one or more embodiments. With this more standard cooktop burner configuration, the larger burners are provided even greater spacing apart from each other when the front burners are in the extended position.

Figure 9C:
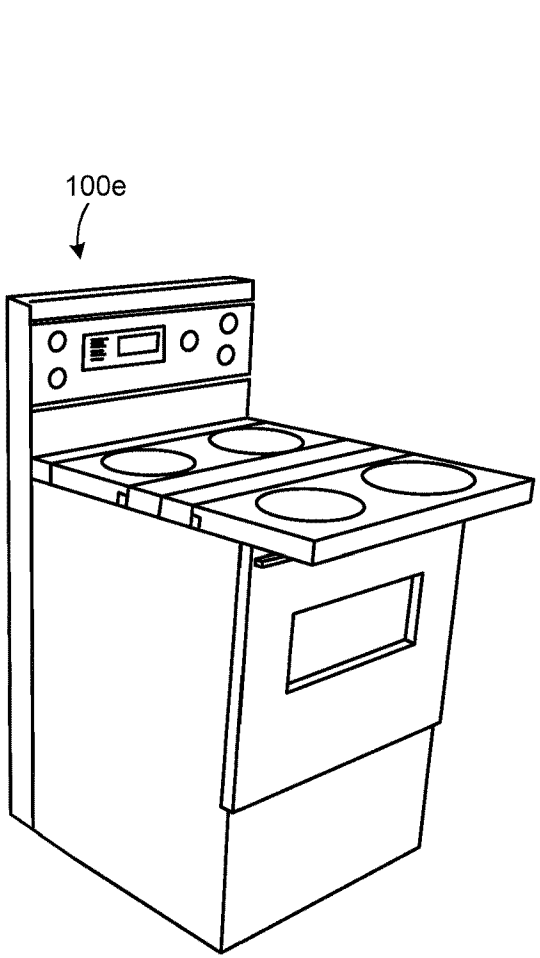
FIGS. 9A-9C illustrates three different three-dimensional views of an expandable depth cooking appliance with both the rear and front burner sections being forward slideable to receive respective expansion block panels in the created back or middle spaces, according to one or more embodiments.
Figure 9B:
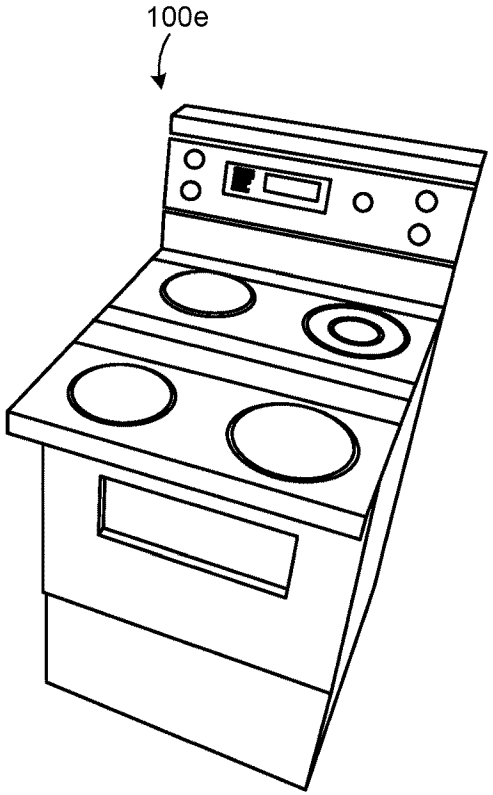
Figure 9A:
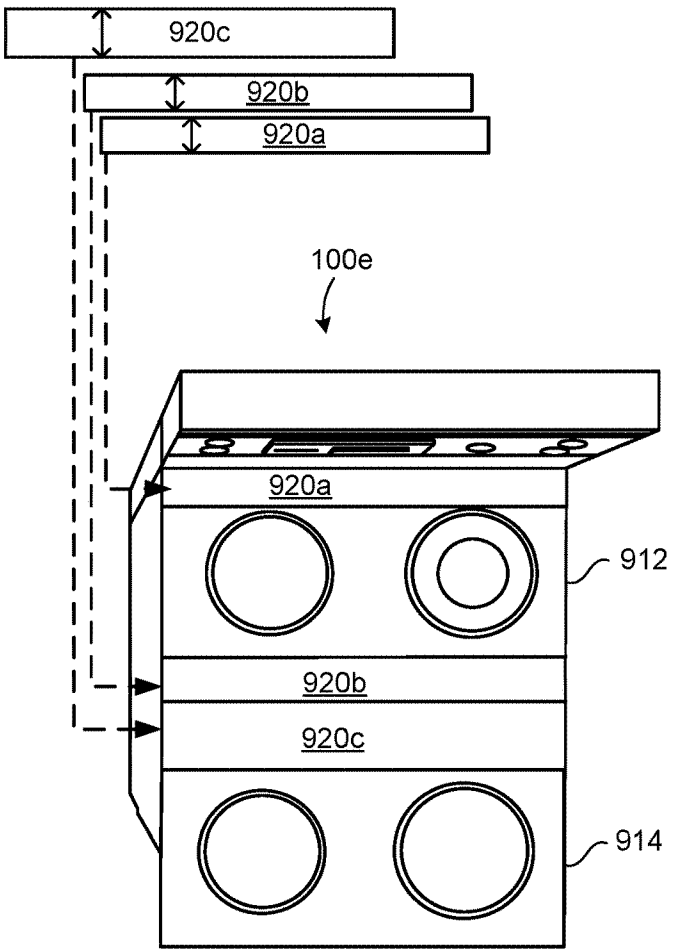

FIGS. 9A-9C illustrates three different three-dimensional views of cooking appliance 100*e* as a multi-expandable cooktop stove with both the moveable front burner section and rear burner assemblies and three expansion inserts panels installed both at the back and in the middle of the cooktop, according to alternate embodiments. As provided by this alternate embodiment, the fully expanded stovetop includes both a front and a rear moveable (slideable) burner sections, supporting the insertion of both a back insert panel 920*a* and one or more middle insert panels 920*b*-920*c*. Additionally, FIGS. 9A-9C also depicts cooking appliance 100*e* having front burner section 914 extended with two expansion block insert panels 920*b*, 920*c* inserted within the separation space between the rear and front burner sections 912, 914, according to one or more embodiments.

The rear burner section 912 is affixed at the bottom to the sliding portion of the middle sliding bracket. The front burner section 914 is affixed at the bottom to the left and right sliding rails and the sliding component of the middle sliding bracket. With this assembly, additional spacing is also provided at the rear of the cooktop to allow the rear burners to be able to accommodate much larger sized pots, frying pans, and other cooking utensils. Different widths of the created separation spaces can be provided in alternate embodiments. As further shown by FIG. 9A, the lateral separation of the rear and front burner sections 112, 114 provides a middle section that can be four or more inches wide to create space between the burners. Further, with the illustrative embodiment, the back separation space of the rear burner section is smaller than the middle separation space. As an example, a separation of two (2) inches can be created from the back of the cooking appliance (stove) 100*e* when pulling the back burner section 912 forward to create space at the back of the stovetop.

Figure 10:
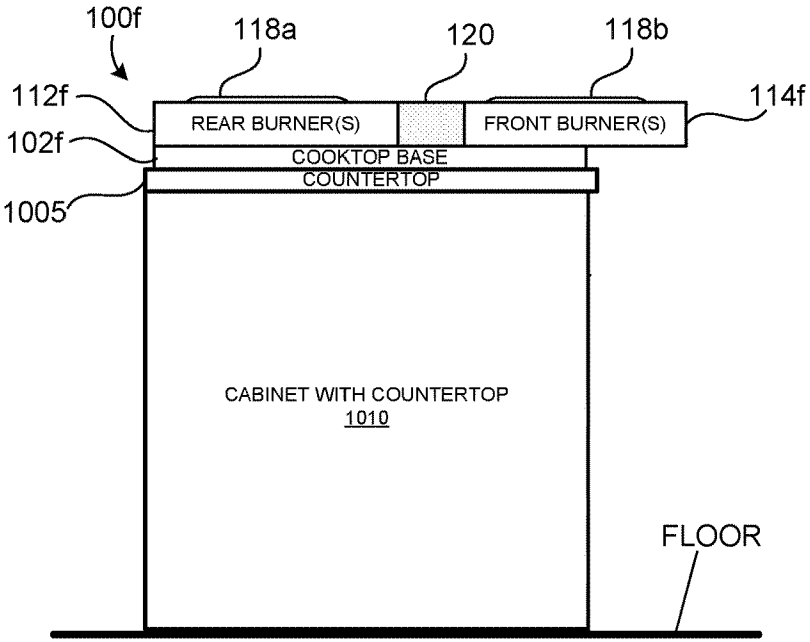
FIG. 10 illustrates an expandable depth cooktop, which extends over a vertical edge of a standard depth countertop in/on which the cooktop is placed, according to one or more embodiments.

FIG. 10 presents a side view of example cooking appliance 100*f* designed as a countertop cooking appliance, according to one embodiment. As shown, cooking appliance 100*f* has base 102*f* that sits on top of (or inserted within) countertop 1005 which is a top surface area of base cabinet 1010. Moveable front burner section 114*f* is translated forward past a vertical line representing the front edge of the standard depth countertop or base cabinet 1010 on which the cooktop is placed. A block insert panel 120 is inserted within the space between moveable front burner section 114*f* and stationary rear burner section 112*f*. Rear and front burners 118*a*-*b*, 118*c*-*d* have increased separation space. A side panel (not shown) can optionally be provided for both left and right sides of moveable front burner section 114*f*.

Figure 11A:
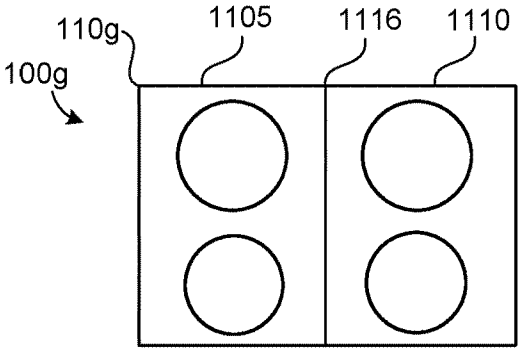
FIGS. 11A-11C present an expandable width cooking appliance, with one or two slideable burner sections arranged side-by-side to enable a larger width cooking surface, according to one or more embodiments.
Figure 11B:
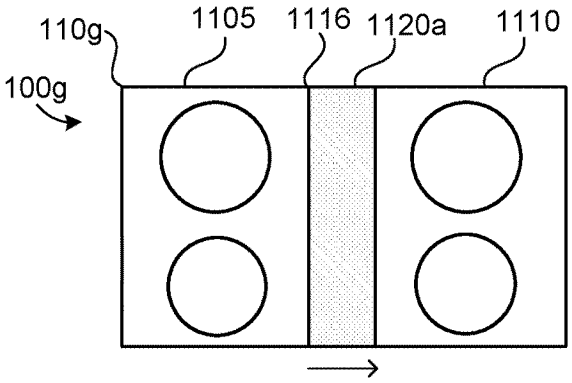
Figure 11C:
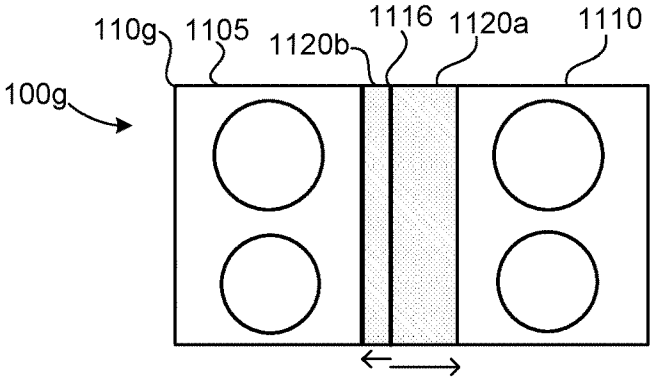

FIGS. 11A-11C presents an alternate configuration of cooking appliance 100*g* presented as an expandable width cooking appliance (100*g*) configured with an expandable width cooktop surface 110*g*. Specifically, FIGS. 11A-11C illustrate other embodiments of cooking appliance 100*g* configured as a cooktop which supports expansion to a larger width cooktop by sliding one or both of a left and a right section of cooktop outwards to the right and/or left, respectively, from a base configuration. Cooking surface 110*g* includes bifurcated burner sections arranged side-by-side at separating joint 1116, with a right-side burner section 1105 and a left side burner section 1110. At least one of right-side burner section 1105 and a left side burner section 1110 is translatable outward to the right and left, respectively, to provide an expandable width cooking surface. As shown, cooktop surface 110*g* is divided into left burner section 1105 and right burner section 1110, separated at connecting joint 1116. As further presented by the figures, one or more expansion block insert panels 1120*a*, 1120*b* can be inserted into the space/gap created running from the rear to the front of cooktop when one or both of left burner section 1105 and right burner section 1110 are slid outwards away from connecting joint 1116. The appropriate size block insert panel 1120*a*/1120*b* is then inserted from back to front into the gap/space created following the outward translation. Other mechanical and functional features are supported, similar to those presented with respect to the other configurations of expandable cooktops.

Figure 12:
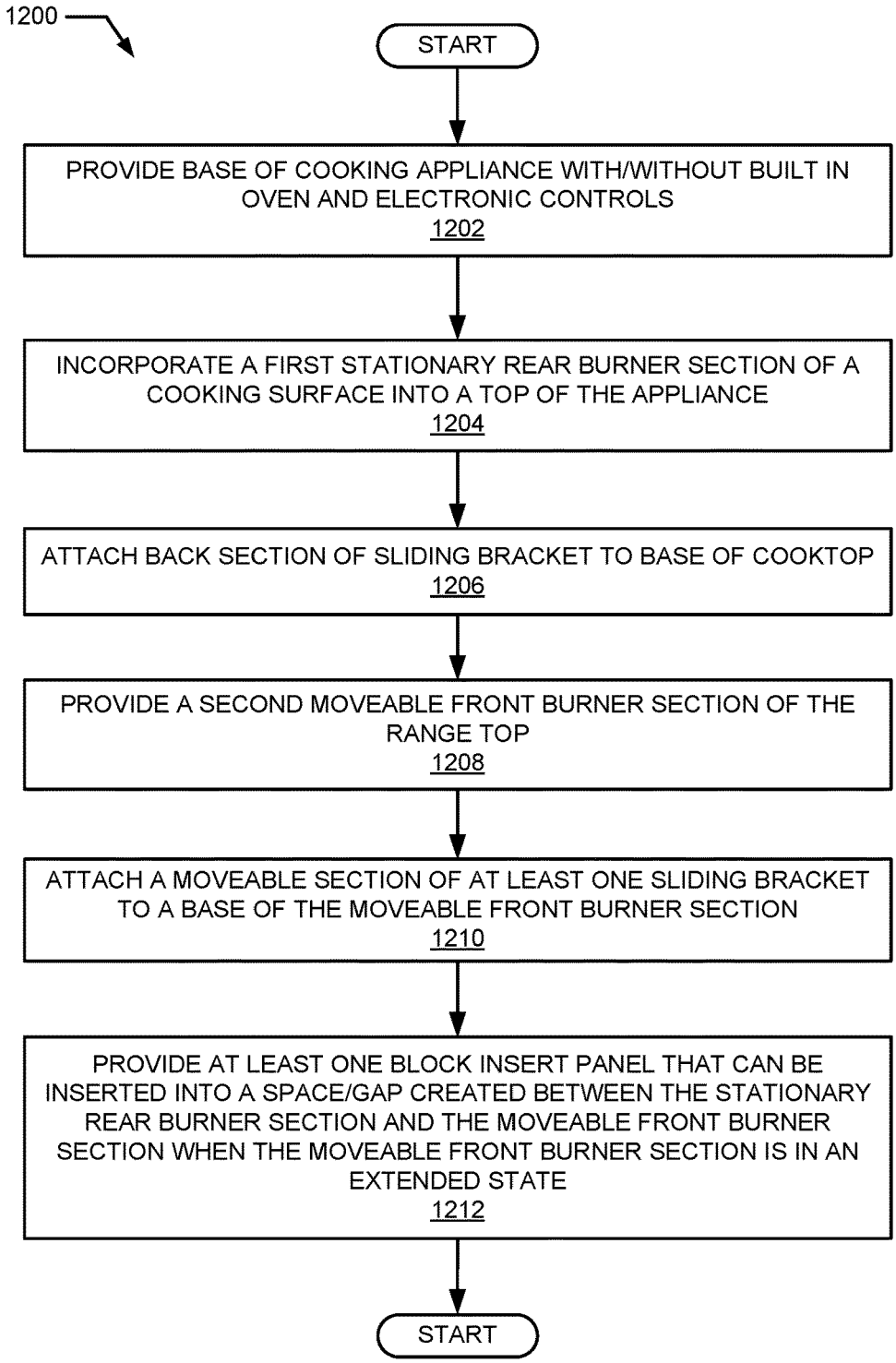
FIGS. 12 and 13 (13A-13B) are flow charts of methods for manufacturing and assembling an expandable cooking appliance, according to one or more embodiments.

Referring now to the flow chart presented by FIG. 12, there is provided method 1200 for assembling example cooking appliance 100 with an extendable/expandable cooking surface 110*g*. Method 1200 includes providing a base of the cooking appliance (block 1202), where the base can be with or without a built-in oven, and the base may include electronic controls. Method 1200 includes incorporating a first stationary rear burner section 112 of a cooking surface 110 into a top of the cooking appliance 100 (block 1204). Method 1200 includes attaching a first fixed section 222*a* of at least one sliding bracket 220 to an upper surface of the top of the base section of cooking appliance 100 (block 1206). Method 1200 then includes providing a moveable front burner section 114 of the cooktop (block 1208) and attaching a second moveable section 222*b* of at least one sliding bracket 220 to a base panel of the moveable front burner section 114 (block 1210). The at least one sliding bracket 220 enables the moveable front burner section to be translated forward into an extended state and then backwards to a retracted state. Method 1200 further includes providing at least one block insert panel 120 that can be inserted into a space/gap created between the stationary rear burner section 112 and the moveable front burner section 114 when the moveable front burner section 114 is translated outwards (block 1212). According to one embodiment, providing the insertable block insert panel 120 includes manufacturing the block insert panel 120 with a high heat resistant surface.

Figure 13A:
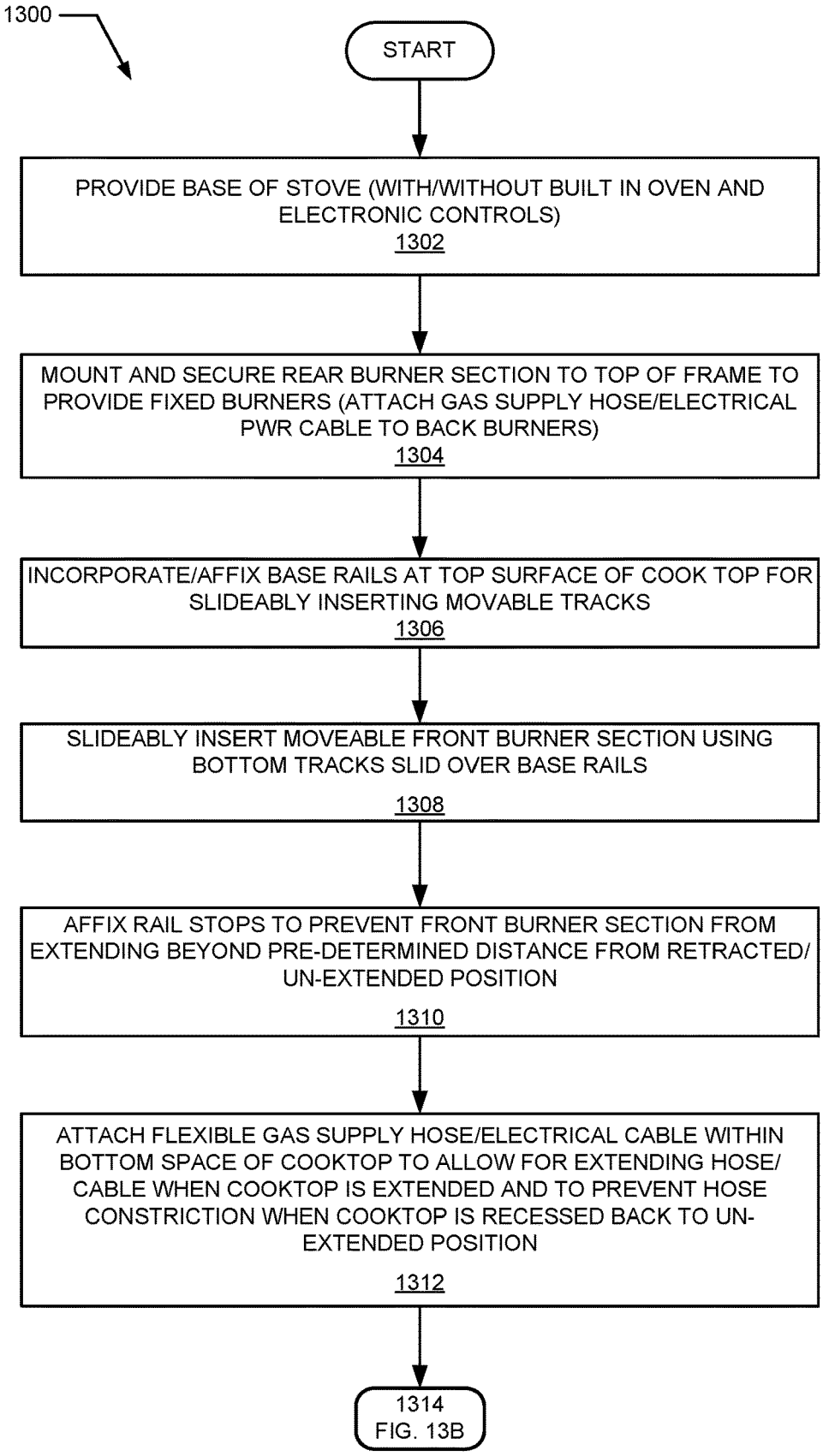
Figure 13B:
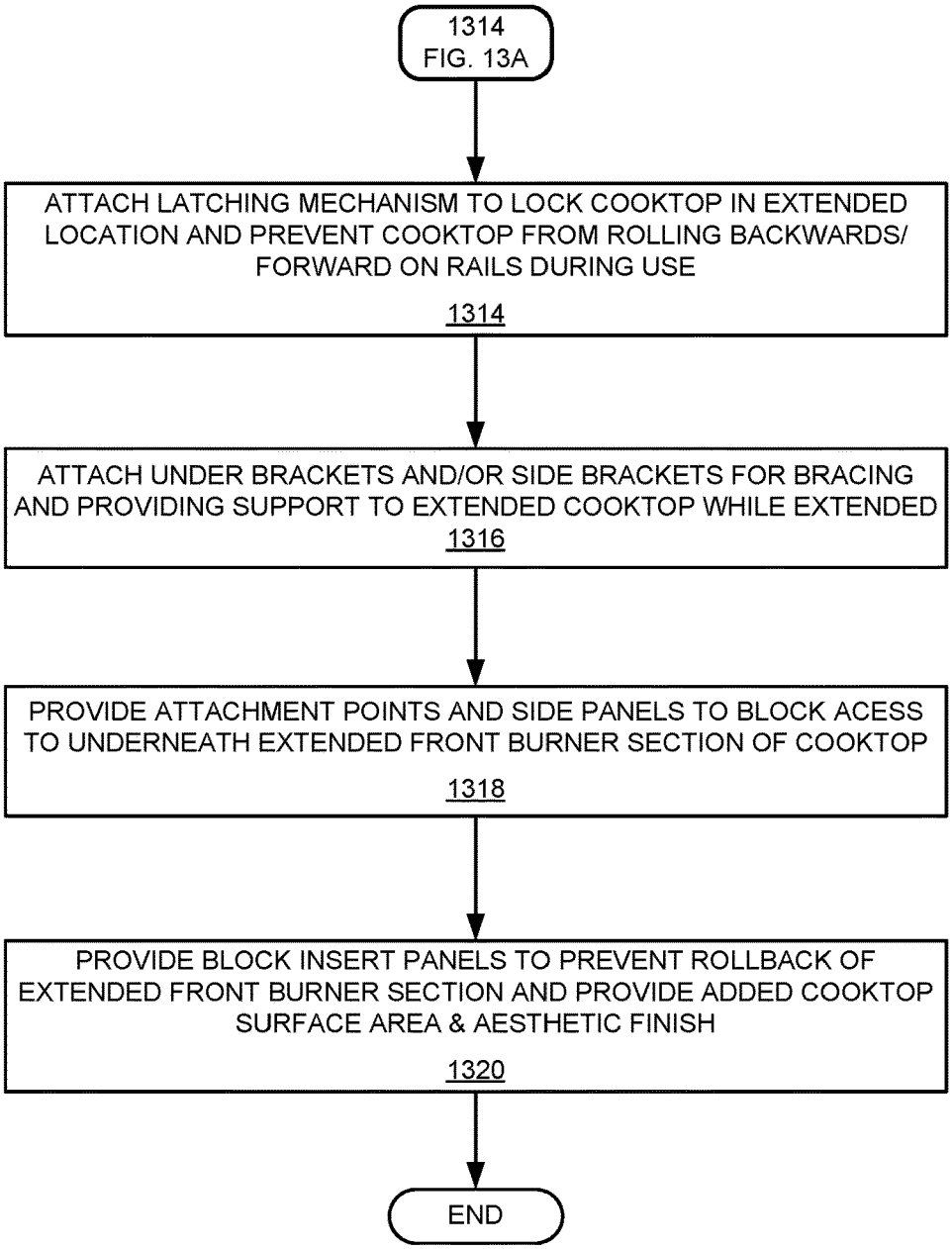

Referring now to FIGS. 13A-13B (collectively FIG. 13), there is presented a more specific sequence of processes of method 1300 for manufacturing of cooking appliance 100. Method 1300 begins at start block and proceeds to block 1302, which includes providing the base of the stove, with/without a built-in oven, and electronic/manual controls. Method 1300 includes mounting and securing the fixed rear burner section to the top of the base to provide a fixed cooking surface (block 1304). Method 1300 optionally includes attaching a gas supply hose or electrical cable to power the back burners. Method 1300 includes incorporating or affixing base supports and sliding brackets rails to the extend to the front section of the base of the cooktop area (block 1306). Method 1300 includes slidably inserting moveable range-top assembly using tracks slid over base rails (block 1308). Method 1300 includes affixing rail stops to prevent the front burner section from extending beyond the pre-determined distance from a retracted/un-extended position (block 1310). Method 1300 includes attaching a flexible gas supply hose (or flexible electrical cable) within a bottom space (block 1312). The flexibility of the gas supply hose or electrical cable allows for extending when the front burner section is extended and prevents hose/cable constriction when the front burner section is recessed back to the base position. Method 1300 then moves to block 1314 (FIG. 13A).

At block 1314, method 1300 includes attaching a latching mechanism to lock the cooktop in the extended position, preventing the front burner section from rolling back or forwards when in the extended or retracted/base position, respectively. Method 1300 includes attaching under brackets and/or side brackets for bracing the extended front burner section while in the extended configuration (block 1316). Method 1300 includes providing attachment points for side panels to block under access to the extended cooktop (block 1318). Method 1300 then includes providing a middle block insert panel to prevent rollback of extended front burner section and extended cooking surface and aesthetic finish (block 1320). Method 1300 then ends.

Additional details related to the manufacture of the different embodiments of the device are not presented by the flow chart, but are understood by those skilled in the art to be details that would necessarily be included in the manufacture of the appliance given the illustrated figures and corresponding brief descriptions presented herein.

The description of the illustrative embodiments can therefore be read in conjunction with the accompanying figures. It will be appreciated that for simplicity and clarity of illustration, elements illustrated in the figures have not necessarily been drawn to scale. For example, the dimensions of some of the elements are exaggerated relative to other elements. Embodiments incorporating teachings of the present disclosure are shown and described with respect to the figures presented herein. Those of ordinary skill in the art will appreciate that the basic configurations depicted in the figures may vary. The illustrative components are not intended to be exhaustive, but rather are representative to highlight essential components that are utilized to implement aspects of the described embodiments. For example, other devices/components/features may be used in addition to or in place of the ones depicted and/or described. The depicted example is not meant to imply design, usage, or other limitations with respect to the presently described embodiments and/or the general innovation.

In the above description, exemplary embodiments in which various aspects of the disclosure may be practiced are described in sufficient detail to enable those skilled in the art to practice the invention. It is to be understood that other embodiments may be utilized, and that logical, architectural, programmatic, mechanical, electrical and other changes may be made without departing from the spirit or scope of the present disclosure. The above description is an extended summary and therefore, should not be taken in a limiting sense, and the scope of the present disclosure will be defined by appended claims and equivalents thereof.

Within the descriptions of the different views of the figures, similar elements are provided similar names and reference numerals as those of the previous figure(s). It will be appreciated that for simplicity and clarity of illustration, elements illustrated in the figures have not necessarily been drawn to scale. For example, the dimensions of some of the elements can be exaggerated relative to other elements.

It is understood that the use of specific component, device and/or parameter nomenclature is for example only and not meant to imply any limitations on the described embodiments. The embodiments may thus be described with different nomenclature and/or terminology utilized to describe the components, devices, parameters, methods and/or functions herein, without limitation. References to any specific proprietary name in describing one or more elements, features or concepts of the embodiments are provided solely as examples of one implementation, and such references do not limit the extension of the claimed embodiments to embodiments in which different element, feature, protocol, or concept names are utilized. Thus, each term utilized herein is to be given its broadest interpretation given the context in which that terms is utilized.

While the disclosure has been described with reference to exemplary embodiments, it will be understood by those skilled in the art that various changes may be made and equivalents may be substituted for elements thereof without departing from the scope of the disclosure. In addition, many modifications may be made to adapt a particular system, device or component thereof to the teachings of the disclosure without departing from the essential scope thereof. Therefore, it is intended that the disclosure not be limited to the particular embodiments disclosed for carrying out the disclosure, but that the disclosure will include all embodiments falling within the scope of any appended claims. Moreover, the use of the terms first, second, etc. do not denote any order or importance, but rather the terms first, second, etc. are used to distinguish one element from another.

What is claimed is:

1. An expandable depth cooking appliance comprising:

a base for placement on a surface for physical support;

a multi-section cooking surface integrated atop the base and comprising a stationary rear burner section and a moveable front burner section, the stationary rear burner section comprising at least one rear/back burner, the moveable front burner section comprising at least one front burner, the moveable front burner section translating forward away from the stationary rear burner section to provide a larger separation spacing between the at least one rear/back burner and the at least one front burner; and at least one support member that is securely attached to an upper surface of the base of the cooking appliance and which extends forward below a bottom of the moveable front burner section.

2. The expandable depth cooking appliance of claim 1, further comprising:

at least one sliding bracket attached to an upper surface of a top portion of the base and to a bottom of the moveable front burner section, the at least one sliding bracket enabling the moveable front burner section to be translated forward and backward away from and towards the stationary rear burner section.

3. The expandable depth cooking appliance of claim 2, wherein:

the at least one support member operates in tandem with the at least one sliding bracket to provide structural support for a weight of the moveable front burner section in an extended state.

4. The expandable depth cooking appliance of claim 1, further comprising:

control knobs for turning respective ones of the at least one rear burner and the at least one front burner; and at least one of:

a flexible electrical cable that electrically connects to a heating element of at least one front electrical burner; and a flexible gas line that sealable connects at a gas intake connector of the at least one front burner, the flexible gas line having a second connector that is connectable to a gas intake line outside of the cooking appliance;

wherein both the flexible electrical cable and the flexible gas line extends from a retracted state when the moveable front burner section is translated forward and curls into the retracted state when the moveable front burner is returned back to an un-extended state.

5. The expandable depth cooking appliance of claim 1, further comprising:

a latching mechanism having a first latching part attached to the moveable front burner section and a second latching part attached to one of the stationary rear burner section and a side wall of the base of the cooking appliance, the first and second latching parts interconnecting to secure the moveable front burner section in a retracted state abutting the rear burner section.

6. The expandable depth cooking appliance of claim 1, further comprising:

a block insert panel that is sized to fit into a space created between the stationary rear burner section and the moveable front burner section when the moveable front burner section is moved into an extended state, the block insert panel filling the space and providing additional cooking surface area behind the at least one front burner and in front of the at least one rear burner.

7. The expandable depth cooking appliance of claim 1, wherein each of the at least one rear burner and the at least one front burner comprises a plurality of respective rear and front burners.

8. The expandable depth cooking appliance of claim 1, further comprising:

an oven disposed in a volumetric space below the cooking surface, the oven having a door and handle for accessing an interior of the oven.

9. The expandable depth cooking appliance of claim 1, wherein the moveable front burner section comprises a bottom wall that is made of an insulated material to prevent transfer of heat from a base of the at least one front burner.

10. The expandable depth cooking appliance of claim 1, further comprising at least one side panel that attaches to and extends downwards from a side wall or bottom of the moveable front burner section as a skirt and that prevents access to a space directly beneath the moveable front burner section when the moveable front burner section is in an extended state with the side panel attached.

11. A method for providing an extendable/expandable cooking surface for a cooking appliance, the method comprising:

incorporating a stationary rear burner section of the cooking surface into a top of the cooking appliance;

providing a moveable front burner section of the cooking surface;

attaching a first section of at least one sliding bracket to a base of the moveable front burner section;

attaching a second section of the at least one sliding bracket to an upper surface of the cooking surface in front or underneath of the first stationary rear burner section, the at least one sliding bracket enabling the moveable front burner section to be translated forward into an extended state and then backwards to a retracted state; and attaching at least one support member to an upper surface of the base of the cooking appliance, the at least one support member extending forward below a bottom of the moveable front burner section.

12. The method of claim 11, further comprising:

providing a block insert panel that can be inserted into a space created between the stationary rear burner section and the moveable front burner section when the moveable front burner section is translated forward to the extended state.

13. The method of claim 12, wherein providing the insertable block panel further comprises manufacturing the insertable block panel with a high heat resistant surface.

14. The method of claim 12, wherein the block insert panel is sized to fit into a space created between the stationary rear burner section and the moveable front burner section when the moveable front burner section is moved into the extended state, the block insert panel filling the space and providing additional cooking surface area behind the at least one front burner and in front of the at least one rear burner.

15. The method of claim 11, wherein the moveable front burner section comprises a bottom wall that is made of an insulated material to prevent transfer of heat from a base of the at least one front burner.

16. The method of claim 11, wherein the at least one support member operates in tandem with the at least one sliding bracket to provide structural support for a weight of the moveable front burner section in an extended state.

17. The method of claim 11, further comprising:

providing at least one side panel that attaches to and extends downwards from a side wall or bottom of the moveable front burner section as a skirt and that prevents access to a space directly beneath the moveable front burner section when the moveable front burner section is in an extended state with the side panel attached.

18. The method of claim 11, further comprising:

attaching a first latching part of a latching mechanism to the moveable front burner section;

attaching a second latching part to one of the stationary rear burner section and a side wall of the base of the cooking appliance, the first and second latching parts interconnecting to secure the moveable front burner section in a retracted state abutting the rear burner section.

* * * * *